US008598803B2

(12) United States Patent
Kuo et al.

(10) Patent No.: US 8,598,803 B2
(45) Date of Patent: Dec. 3, 2013

(54) LED DRIVER HAVING A PRE-CHARGEABLE FEEDBACK FOR MAINTAINING CURRENT AND THE METHOD USING THE SAME

(75) Inventors: Chun-Ting Kuo, Pingtung County (TW); Chun-Fu Lin, Taoyuan County (TW); Cheng-Han Hsieh, Hsinchu County (TW)

(73) Assignee: MY-Semi Inc., Hsinchu (TW)

( * ) Notice: Subject to any disclaimer, the term of this patent is extended or adjusted under 35 U.S.C. 154(b) by 373 days.

(21) Appl. No.: 12/975,362

(22) Filed: Dec. 22, 2010

(65) Prior Publication Data

US 2011/0156604 A1 Jun. 30, 2011

(30) Foreign Application Priority Data

Dec. 31, 2009 (TW) ..... 98146199 A

(51) Int. Cl.
*G05F 1/00* (2006.01)

(52) U.S. Cl.
USPC ..... 315/291; 315/247; 315/185 S; 315/307; 315/312

(58) Field of Classification Search
USPC ..... 315/247, 224, 225, 185 S, 291, 307–326
See application file for complete search history.

(56) References Cited

U.S. PATENT DOCUMENTS 6,057,651 A * 5/2000 Usami ..... 315/291
7,675,245 B2 * 3/2010 Szczeszynski et al. ..... 315/291

* cited by examiner

*Primary Examiner* — Tuyet Thi Vo
(74) *Attorney, Agent, or Firm* — Litron Patent and Trademark Office; Min-Lee Teng

(57) ABSTRACT

A driving circuit of a light emitting diode (LED), including a driving unit, a current pre-charging unit and a feedback unit, is provided. The driving unit outputs a driving power to drive the LEDs and outputs at least one first feedback signal according to the current conducted in the LEDs. The current pre-charging unit is coupled to an output of the driving unit to provide a current path to the driving unit and generates a second feedback signal. One of the at least one first feedback signal is selected to adjust the driving power when the enable signal is at a first logic level; the second feedback signal is selected to adjust the driving power when the enable signal is at a second logic level so as to maintain a current to drive the LEDs.

19 Claims, 10 Drawing Sheets

LED DRIVER HAVING A PRE-CHARGEABLE FEEDBACK FOR MAINTAINING CURRENT AND THE METHOD USING THE SAME

CROSS-REFERENCE TO RELATED APPLICATION

This application claims the priority benefit of Taiwan application serial no. 98146199, filed on Dec. 31, 2009. The entirety of the above-mentioned patent application is hereby incorporated by reference herein and made a part of this specification.

BACKGROUND OF THE INVENTION

1. Field of the Invention

The invention generally relates to a driving circuit of a light emitting diode (LED), and more specifically, to a driving circuit for maintaining a current driving ability.

2. Description of Related Art

As concerns for environmental and energy preservation have drastically increased, the light emitting diode (LED) has gradually overtaken traditional incandescent light sources as the light source of the new millennium, owing to its small size, energy efficiency and durability. The LED emits light by converting electrical energy into light energy. Since an LED chip is made of semiconductor materials, the emitted wavelength is determined by the energy gap levels of the materials used, thereby allowing the LED to emit different colors of light. Therefore, not only can the LED be used as a white light source, but it may also be adopted as automobile headlights, traffic signals, text displays, billboards and other large displays, as well as regular and architectural lighting and backlights for a liquid crystal display (LCD), etc.

Since the emitted brightness of the LED is related with the size of the current conducted, the driving capability of the current is emphasized while driving the LED. Especially for large LED billboards, since the purpose is to display images or texts, the response time of the LED is of great importance. In large LED billboards, due to the large number of LEDs, a significant magnitude of current is needed for driving the billboards. If a driving circuit cannot provide enough current in time, then the LED might not be able to display accurate brightness and image quality. Therefore, for an LED display or billboard, a current driving ability of an LED driving circuit becomes a matter of great importance. However, conventional LED driving circuits mainly focus on current stability or driving voltage control, but few have placed emphasis on improving the driving ability of the driving current.

SUMMARY OF THE INVENTION

The present invention provides a driving circuit of a light emitting diode (LED) and a driving method thereof. A current pre-charging unit is disposed in the driving circuit, so as to maintain a current driving capability of the driving circuit to provide a sufficient current to drive the LED when the LED is being switched on. Accordingly, a switching speed of the LED is accelerated, thereby preventing the issue of insufficient current affecting a display speed of the LED.

In light of the foregoing, an aspect of the invention provides a driving circuit adapted to drive at least an LED unit, in which the LED unit includes at least an LED. The driving circuit includes a driving unit, a current pre-charging unit, and a feedback selecting unit. The driving unit outputs a driving power to the LED unit, and outputs at least a first feedback signal according to a current conducted by the LED unit. The current pre-charging unit is coupled to an output of the driving unit to provide a current path to the driving unit, and the current pre-charging unit generates a second feedback signal according to the driving power. The feedback selecting unit is coupled to the driving unit and the current pre-charging unit, and according to an enable signal, the feedback selecting unit selects one of the first feedback signals or the second feedback signal FS as an output. The driving unit adjusts the driving power according to the output of the feedback selecting unit.

In one embodiment of the invention, when the enable signal is disabled and the LED unit is turned off, the feedback selecting unit selects the second feedback signal as the output, so that an output current of the driving unit is maintained at a predetermined value. When the enable signal is enabled and the LED unit is turned on, the feedback selecting unit selects one of the first feedback signals having a smallest voltage as the output.

In one embodiment of the invention, the pre-charging unit includes a first resistor, a second resistor, an inverter, and a switch. The first resistor and the second resistor are serially coupled between the output of the driving unit and the switch. The inverter has an input end coupled to the enable signal and an output end coupled to the switch. When the enable signal is disabled, the switch is turned on, and when the enable signal is enabled, the switch is turned off.

In one embodiment of the invention, the above-described current pre-charging unit includes a first resistor, an adjustable current source, a control unit, and a delay unit. An end of the first resistor is coupled to the output of the driving unit, and the adjustable current source is coupled between another end of the first resistor and the ground. The control unit is coupled to the adjustable current source, and according to an original enable signal, the control unit adjusts a conducted current of the adjustable current source. The delay unit is coupled between the feedback selecting unit, the current controlling circuit, and the original enable signal. The delay unit is configured to delay the original enable signal a predetermined time so as to output the enable signal to the feedback selecting unit and the current controlling circuit. A node between the adjustable current source and the first resistor outputs the second feedback signal. During the predetermined time delay, the control unit changes the conducted current of the adjustable current source in accordance with the original enable signal, so as to increase an output current of the driving unit. Moreover, when the LEDs are turned on (i.e., after the predetermined time delay), the current of the adjustable current source is automatically turned off.

Another aspect of the invention provides a driving method of an LED, including the following steps. A driving power is outputted to drive an LED unit and generate at least a first feedback signal. Moreover, a current path is provided to the driving power, and a second feedback signal is generated according to a current conducted by the current path. According to an enable signal, whether to turn on the LEDs is determined. For example, when the enable signal is at logic level one, the driving power is conducted to the LED unit to turn on the LED s; and when the enable signal is at logic level zero, the driving power is not conducted to the LED unit so as to turn off the LEDs.

When the LED unit is turned off, the driving power is adjusted according to the second feedback signal. When the LED unit is turned on, the driving power is adjusted according to the first feedback signal. Please refer to the foregoing description of the driving circuit for the remaining operating details of the driving method. Hence, a detailed description thereof is omitted.

In summary, according to the invention as embodied and broadly described herein, a current driving capability of the driving circuit is maintained by an advance adjustment to a current, so that a sufficient current may be provided to an LED when the LED is being switched, and thereby accelerating a turn on time of the LED. Moreover, an embodiment of the invention uses the current pre-charging unit to provide feedback signals, so that even when the LED is turned off, the driving circuit may adjust the output of the power converting unit according to the feedback signals.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

First Embodiment

Figure 1A:
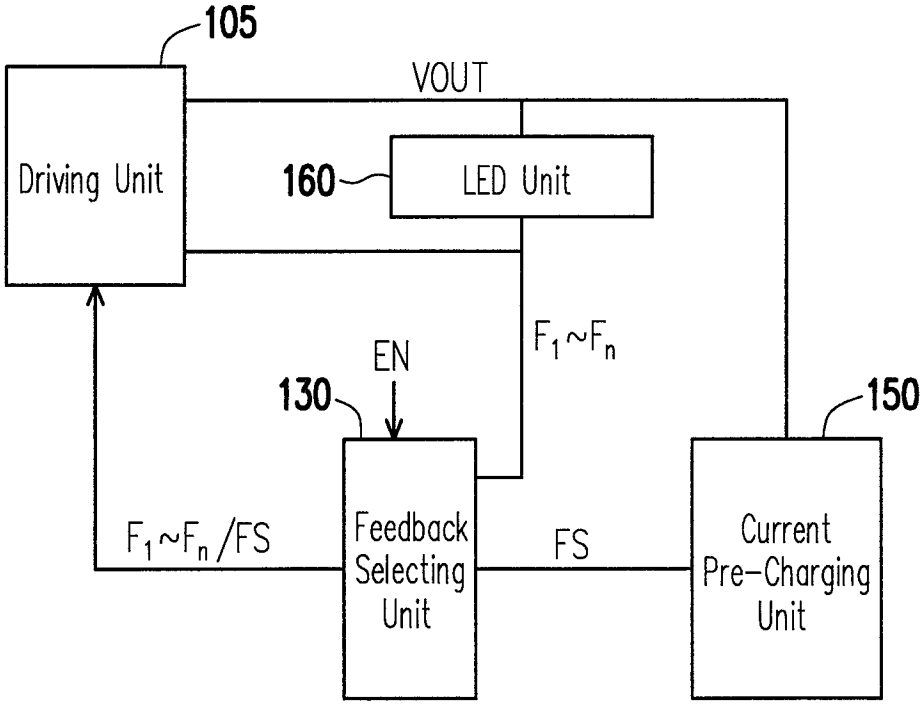
FIG. 1A is a schematic block diagram of a driving circuit in accordance with a first embodiment of the invention.

Referring to FIG. 1A, FIG. 1A is a schematic block diagram of a driving circuit in accordance with a first embodiment of the invention. The driving circuit is adapted to drive at least a light emitting diode (LED), and the driving circuit includes a driving unit 105, a feedback selecting unit 130, and a current pre-charging unit 150. The driving unit 105 is coupled to an LED unit 160, and the LED unit 160 includes at least a LED. The LEDs may form an LED string by mutually connecting in series. The driving unit 105 outputs a driving power VOUT to the LED unit 160, and outputs at least a first feedback signal $F_1$-$F_n$ according to a current conducted by the LED string (not shown). The current conducted by the LED string can be derived by the first feedback signals $F_1$-$F_n$ corresponding to the divided voltage of each LED string. The current pre-charging unit 150 is coupled to an output of the driving unit 105 to provide a current path to the driving unit 105. Moreover, the current pre-charging unit 150 generates a second feedback signal FS according to a current conducted by the current pre-charging unit 150, or a voltage level of the driving power VOUT. The feedback selecting unit 130 is coupled to the driving unit 105 and the current pre-charging unit 150. The feedback selecting unit 130 selects the first feedback signals $F_1$-$F_n$ or the second feedback signal FS according to an enable signal EN. The driving unit 105 adjusts the driving power VOUT according to an output of the feedback selecting unit 130.

When the LED string in the LED unit 160 is turned on, the feedback selecting unit 130 selects one of the first feedback signals $F_1$-$F_n$ as the output (e.g., a feedback signal having a lowest voltage), and the driving unit 105 adjusts the driving power VOUT according to the selected feedback signal. At this time, the operation of the entire driving circuit is similar to a conventional LED driving circuit, in that a feedback signal of an LED device is used to adjust the driving voltage VOUT. Generally speaking, the first feedback signals $F_1$-$F_n$ are related to a current conducted by a corresponding LED. When the LEDs in the LED unit 160 are turned off, the feedback selecting unit 130 selects the second feedback signal FS as the output. The driving unit 105 adjusts the driving power VOUT according to the second feedback signal FS. In other words, when the LED unit 160 is turned off, the driving unit 105 still maintains a magnitude of output current for conducting the LED unit 160.

The current pre-charging unit 150 may be viewed as a second output current path of the driving unit 105. When the LEDs in the LED unit 160 are temporarily turned off (i.e. when switched off by the enable signal EN), an output current of the driving unit 105 may be maintained by the current pre-charging unit 150, so as to prevent the output current from being lowered to zero. Accordingly, when the LEDs are again conducted, the driving unit 105 is capable of rapidly providing a large current to the LEDs, thereby preventing a delay in conducting the LEDs that may affect normal display. At this time, the current pre-charging unit 150 may coordinate with the conduction of the LEDs by temporarily shutting down, so as to lower current consumption. Then, according to the enable signal EN, a turn on time of the current pre-charging unit 150 may be determined.

Figure 1B:
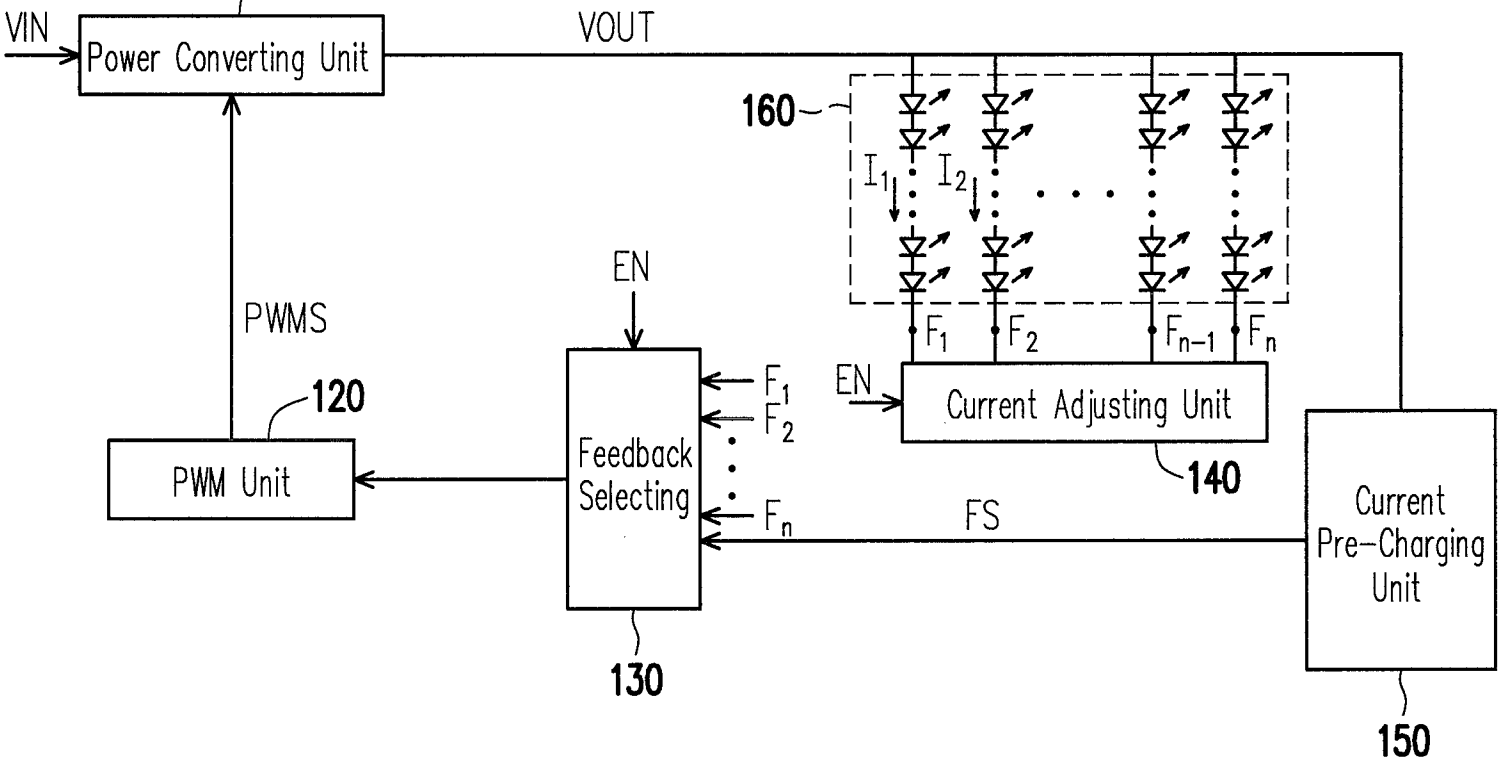
FIG. 1B is a circuit diagram of a driving unit 105 in accordance with the first embodiment of the invention.

Next, a circuit of the driving unit 105 is further illustrated in the following. Referring to FIG. 1B, FIG. 1B is a circuit diagram of the driving unit 105 in accordance with the first embodiment of the invention. The driving unit 105 includes a power converting unit 110, a pulse width modulating (PWM) unit 120, and a current adjusting unit 140. The power converting unit 110 is coupled to the LED unit 160 formed by a plurality of LED strings, and the power converting unit 110 is configured to convert an input voltage VIN to the driving voltage VOUT for the LED strings in the LED unit 160. The LED strings in the LED unit 160 are formed by a plurality of LEDs connected in series respectively. One end of each LED string is coupled to the driving voltage VOUT; and the other end of the LED string is coupled to the current adjusting unit 140. The current adjusting unit 140 has a capability to control a conducting current of each of the LED strings and may selectively conduct specific LED strings when the enable signal EN is enabled. The current pre-charging unit 150 is coupled to an output of the power converting unit 110, and the feedback selecting unit 130 is coupled to the current pre-charging unit 150 and the PWM unit 120. The feedback selecting unit 130 may receive the first feedback signals $F_1$-$F_n$ coming from the current adjusting unit 140, and may receive the second feedback signal FS coming from the current pre-charging unit 150. The first feedback signals F1-Fn feedback voltages of nodes connecting the LED strings and the current adjusting unit 140. The second feedback signal FS coming from the current pre-charging unit 150 changes according to a size of the current conducted.

The PWM unit 120 may adjust a PWM signal PWMS according to a feedback signal selected by the feedback selecting unit 130, so that the power converting unit 110 outputs a corresponding driving power VOUT. In another embodiment of the invention, the driving unit 105 may also employ a pulse frequency modulating unit to adjust the driving power VOUT. In other words, the pulse frequency modulating unit may be used to replace the PWM unit 120.

When the enable signal EN is enabled, the current adjusting unit 140 conducts and lights the LED strings. At this time the feedback selecting unit 130 selects one of the first feedback signals $F_1$-$F_n$ corresponding to the conducted LED strings (e.g., a feedback signal having the lowest voltage at a specified connecting node), and outputs the selected feedback signals to the PWM unit 120. The PWM unit 120 adjusts the output of the power converting unit 110 according to the selected feedback signal, so that the LED strings have a sufficient driving current. When the enable signal EN is disabled, the current adjusting unit 140 turns off the LED strings to block the current from flowing into the LED strings. At this time, the feedback selecting unit 130 selects and outputs the second feedback signal FS to the PWM unit 120. The PWM unit 120 adjusts the output of the power converting unit 110 according to the second feedback signal FS, so that an output current or an output voltage of the power converting unit 110 is maintained at a predetermined value.

In other words, the present embodiment adds a current path in the driving circuit of the LEDs, so that the power converting unit 110 may maintain an output current value, and therefore current output is not discontinued due to a conductive state of the LEDs. In the present embodiment of the invention, when the LEDs are turned off, the magnitude of the conducted current by the power converting unit 110 may be maintained by the current pre-charging unit 150 so that the power converting unit 110 continues to output current. Accordingly, when the enable signal EN is enabled and the power converting unit 110 may directly provide a required current for conducting the LEDs as long as the current pre-charging unit 150 discontinues conducting current, and therefore an issue of insufficient driving current is prevented. The magnitude of current conducted by the current pre-charging unit 150 may be determined according to a design requirement, wherein the magnitude of the conducted current may be controlled by the feedback selecting unit 130 or by a direct setting. The invention is not limited to the aforementioned methods of setting the magnitude of the conducted current. It is sufficient if the current pre-charging unit 150 can provide a current path for the power converting unit 110. Moreover, the current pre-charging unit 150 needs not to be continuously conducting. To save power, the current pre-charging unit 150 may be configured to conduct only before the LED is turned on so that the current driving capability is maintained.

Figure 2A:
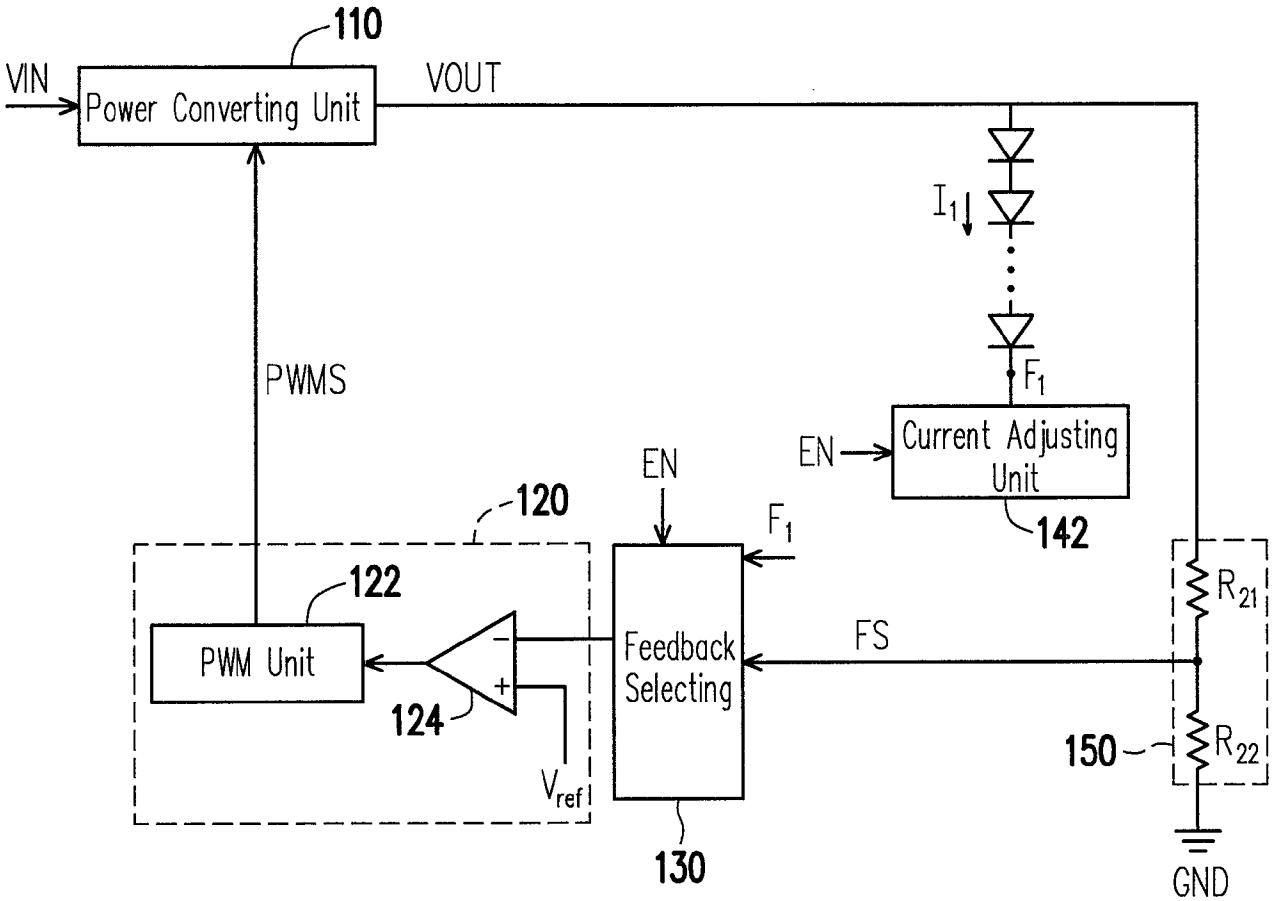
FIG. 2A is a detailed circuit diagram of a driving circuit in accordance with the first embodiment of the invention.

As shown in FIG. 2A, the current pre-charging unit 150 may be formed by serially coupled resistors. FIG. 2A is a detailed circuit diagram of a driving circuit in accordance with the first embodiment of the invention. As an illustrative example, the LED unit 160 is represented as a single LED string, and by setting a corresponding current controlling circuit 142 according to each specific LED string, the current adjusting unit 140 controls a magnitude of current conducted by the LED string. Taking FIG. 2A for example, the current controlling circuit 142 is coupled to an end of the LED string, and the current controlling circuit 142 generates a current $I_1$ according to the enable signal EN. A first feedback signal $F_1$ is generated by a node between the current controlling circuit 142 and the LED string. It should be noted that, according to a circuit design requirement, a metal-oxide-semiconductor (MOS) device may be disposed between the current controlling circuit 142 and the LED string to separate the current controlling circuit 142 and the LED string, and this does not affect the generation of the first feedback signal $F_1$.

The current controlling circuit 142 is formed by a structure including a current source and a current mirror, for example, although the invention is not limited thereto. The current pre-charging unit 150 includes a resistor $R_{21}$ and a resistor $R_{22}$ serially coupled between the driving power VOUT and a ground GND. The PWM unit 120 includes a PWM generator 122 and an operational amplifier 124. An input end of the operational amplifier 124 is coupled to an output of the feedback selecting unit 130 and a reference voltage $V_{ref}$, respectively. An output end of the operational amplifier 124 is coupled to the PWM generator 122.

When the enable signal EN is enabled, the LED string is in a normal display mode (i.e., a conducting mode), and the feedback selecting unit 130 selects the first feedback signal $F_1$ as the output. According to a voltage of the first feedback signal $F_1$, the PWM unit 120 determines whether a voltage and a current of the driving power VOUT are sufficient to drive the LED string, and outputs the PWM signal PWMS to the power converting unit 110. The power converting unit 110 is a boost circuit or a buck circuit, for example, that uses a duty cycle of the PWM signal PWMS to adjust a voltage value of the driving power VOUT. In conventional techniques, when the LED string is turned off, the power converting unit 110 lowers the voltage of the driving power VOUT to zero. Therefore, when the LED string is lit again, the power converting unit 110 cannot timely provide a large current to the LEDs. At this time, the LED string may have an issue of a turn-on delay or an inaccurate brightness. To mitigate this issue, the present embodiment adds a current pre-charging unit 150 in the driving circuit, thereby providing the power converting unit 110 another current path so as to maintain the current output of the power converting unit 110. When the LED string is conducting again, the required driving current may be rapidly supplied, and thereby a driving speed is accelerated.

When the LED string is turned off, the feedback selecting unit 130 switches a feedback path to the current pre-charging unit 150, so as to output the second feedback signal FS. According to the second feedback signal FS, the PWM unit 120 adjusts the duty cycle of the PWM signal PWMS, so as to adjust the output voltage of the power converting unit 110. According to a current $I_1$ when the LED string is turned on, the current pre-charging unit 150 may set resistance values of the resistors $R_{21}$ and $R_{22}$, so that the power converting unit 110 may output a corresponding current of a predetermined value when the LED string is turned off. Thereby, the power converting unit 110 may maintain a current driving ability thereof for conducting the LED string.

Figure 2B:
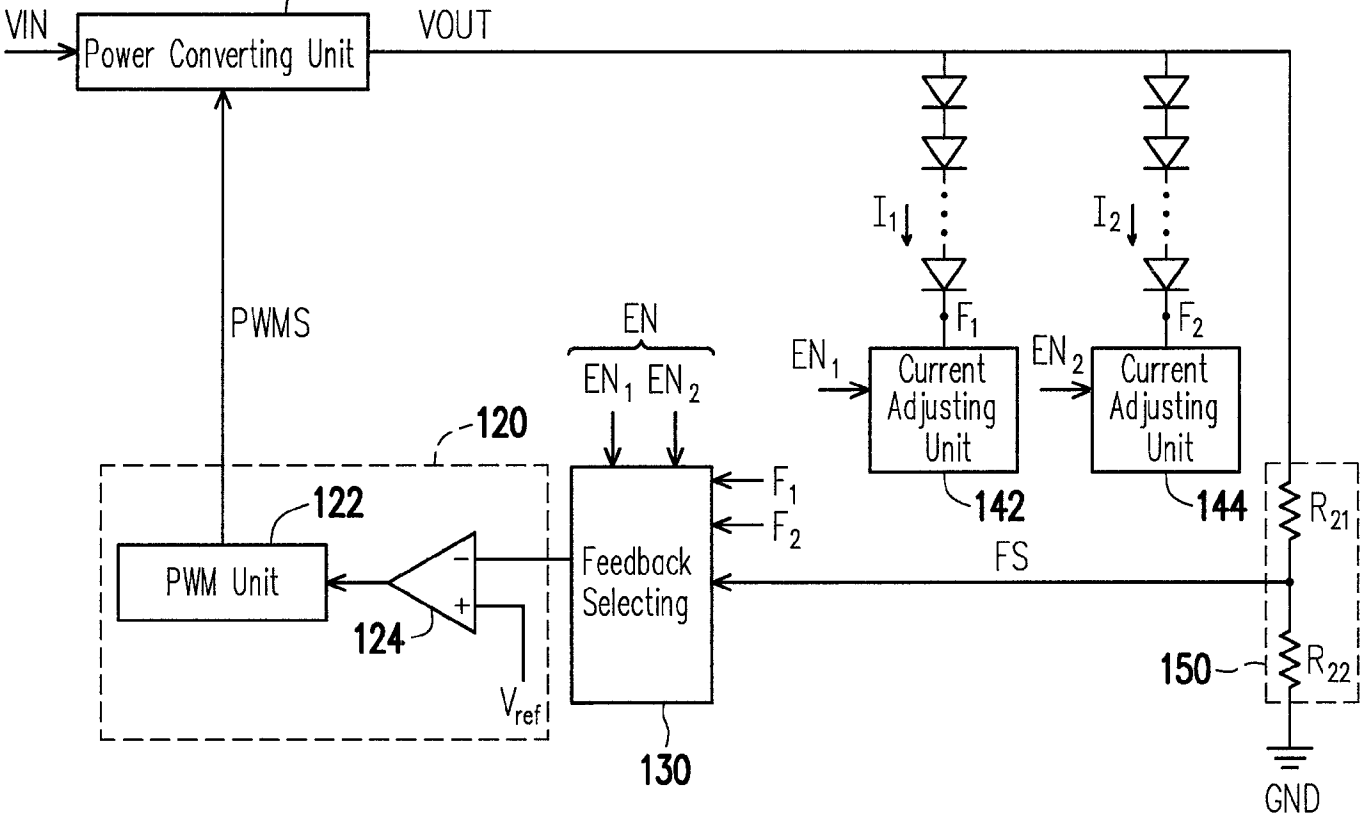
FIG. 2B is a circuit diagram of a driving circuit in accordance with the first embodiment of the invention.

In the present embodiment of the invention, the number of LED strings driven by the power converting unit 110 is not limited. A plurality of LED strings may be driven by the power converting unit 110, and two LED strings are used in an illustrative example hereafter. Referring to FIG. 2B, FIG. 2B is a circuit diagram of a driving circuit in accordance with the first embodiment of the invention. The power converting unit 110 is configured to drive two LED strings, in which the LED strings are coupled between the output of the power converting unit 110 and the current controlling circuits 142 and 144. Nodes between the current controlling circuits 142 and 144 and the LED strings respectively output the first feedback signals F1 and F2 to the feedback selecting unit 130. Moreover, the enable signal EN is used to determine whether to conduct the LED strings. In the present embodiment of the invention, the enable signal EN may include a first enable signal EN1 and a second enable signal EN2, respectively configured to control the current controlling circuits 142 and 144.

Similarly, when the enable signal is enabled, the feedback selecting unit 130 returns one of the first feedback signals $F_1$-$F_2$ to the PWM unit 120. When the enable signal is disabled, the feedback selecting unit 130 returns the second feedback signal FS to the PWM unit 120. The PWM unit 120 adjusts the output of the power converting unit 110 according to the feedback signal received. As other parts of the circuit structure between FIGS. 2B and 2A are similar, and the further descriptions thereof are omitted hereinafter.

Second Embodiment

Figure 3A:
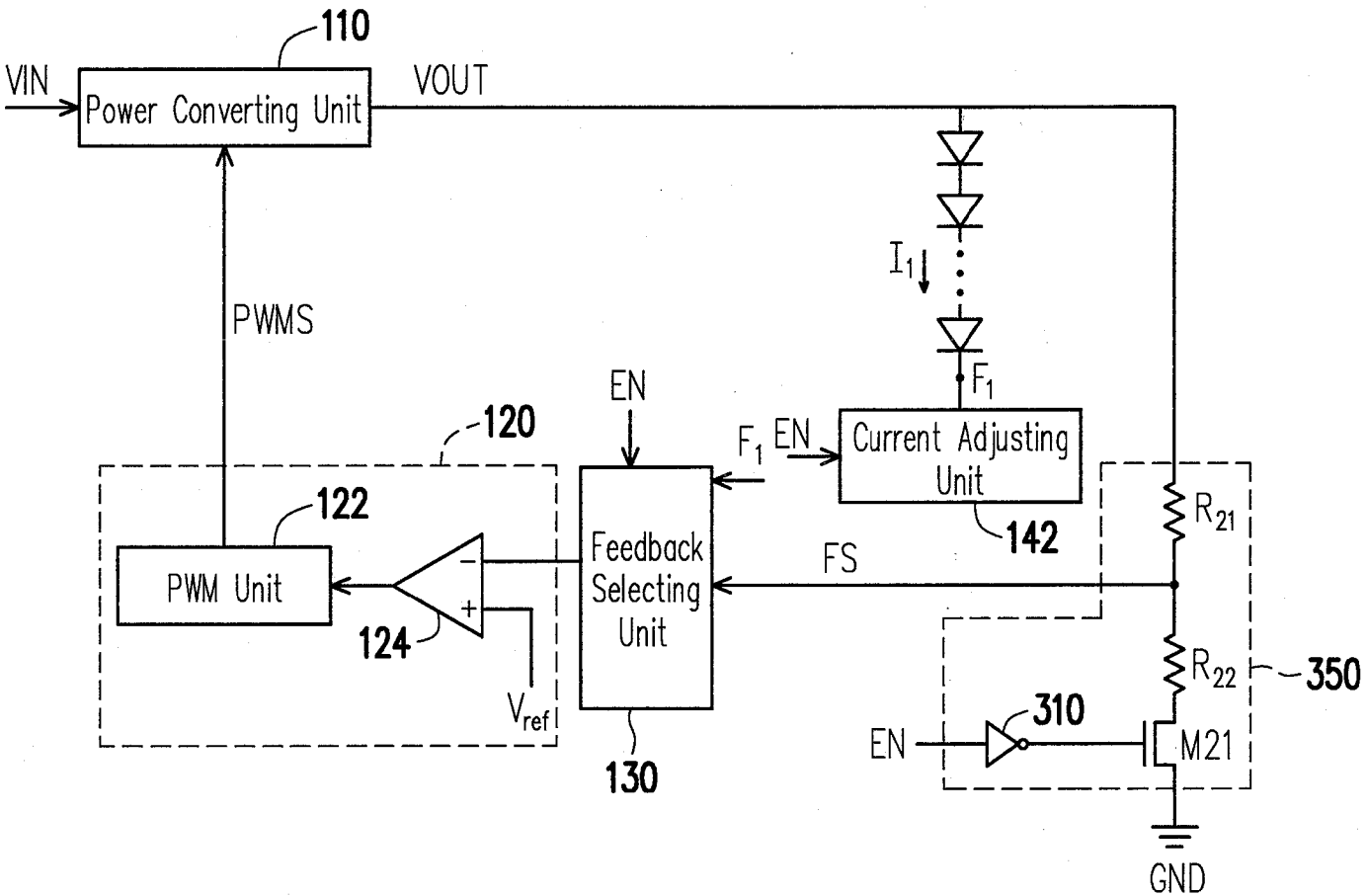
FIG. 3A is a circuit diagram of a driving circuit in accordance with a second embodiment of the invention.

It should be noted that, as shown in FIG. 3A, a switch may be added in the above-described current pre-charging unit 150 (e.g., implemented by a NMOS transistor $M_{21}$) to conserve energy. FIG. 3A is a circuit diagram of a driving circuit in accordance with a second embodiment of the invention. A difference between FIGS. 3A and 2A lies in the NMOS transistor $M_{21}$. A current pre-charging unit 350 depicted in FIG. 3A includes resistors $R_{21}$ and $R_{22}$ along with the NMOS transistor $M_{21}$. The NMOS transistor $M_{21}$ is coupled between the transistor $R_{22}$ and the ground GND, and controlled by an inverted enable signal EN. The NMOS transistor $M_{21}$ may selectively conduct the current pre-charging unit 350. Moreover, when the LED strings need to be turned off for a period of time, or when a display power is turned off, the current pre-charging unit 350 may turn off a current path to conserve power. During normal operation, when the enable signal EN is enabled, the NMOS transistor $M_{21}$ is turned off. When the enable signal EN is disabled, the NMOS transistor $M_{21}$ is turned on. Moreover, the NMOS transistor $M_{21}$ may be controlled by the feedback selecting unit 130 in accordance with the enable signal EN, or the NMOS transistor $M_{21}$ may be controlled by an independent control circuit such as an inverter 310, and the invention is not limited thereto. As other parts of the circuit structure between FIGS. 3A and 2A are similar, and the further descriptions thereof are omitted hereinafter.

Figure 3B:
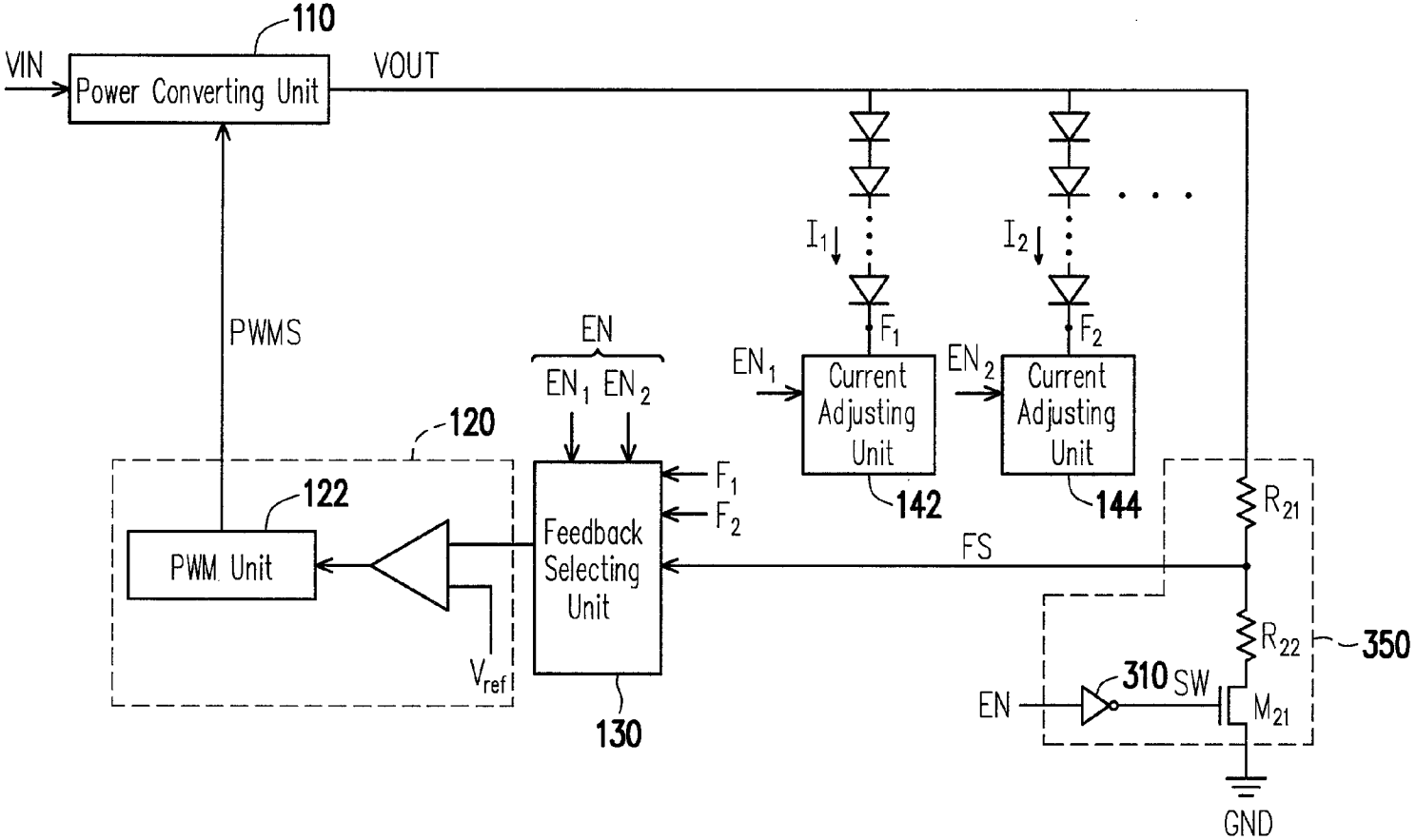
FIG. 3B is a circuit diagram of a driving circuit in accordance with the second embodiment of the invention.

Similarly, FIG. 3A may be adapted to drive a plurality of LED strings, as shown in FIG. 3B. FIG. 3B is a circuit diagram of a driving circuit in accordance with the second embodiment of the invention. FIG. 3B includes two LED strings, and FIGS. 2B and 3B may be referred to for a manner for driving the LED strings, and thus the further descriptions are omitted hereinafter.

Third Embodiment

Figure 3C:
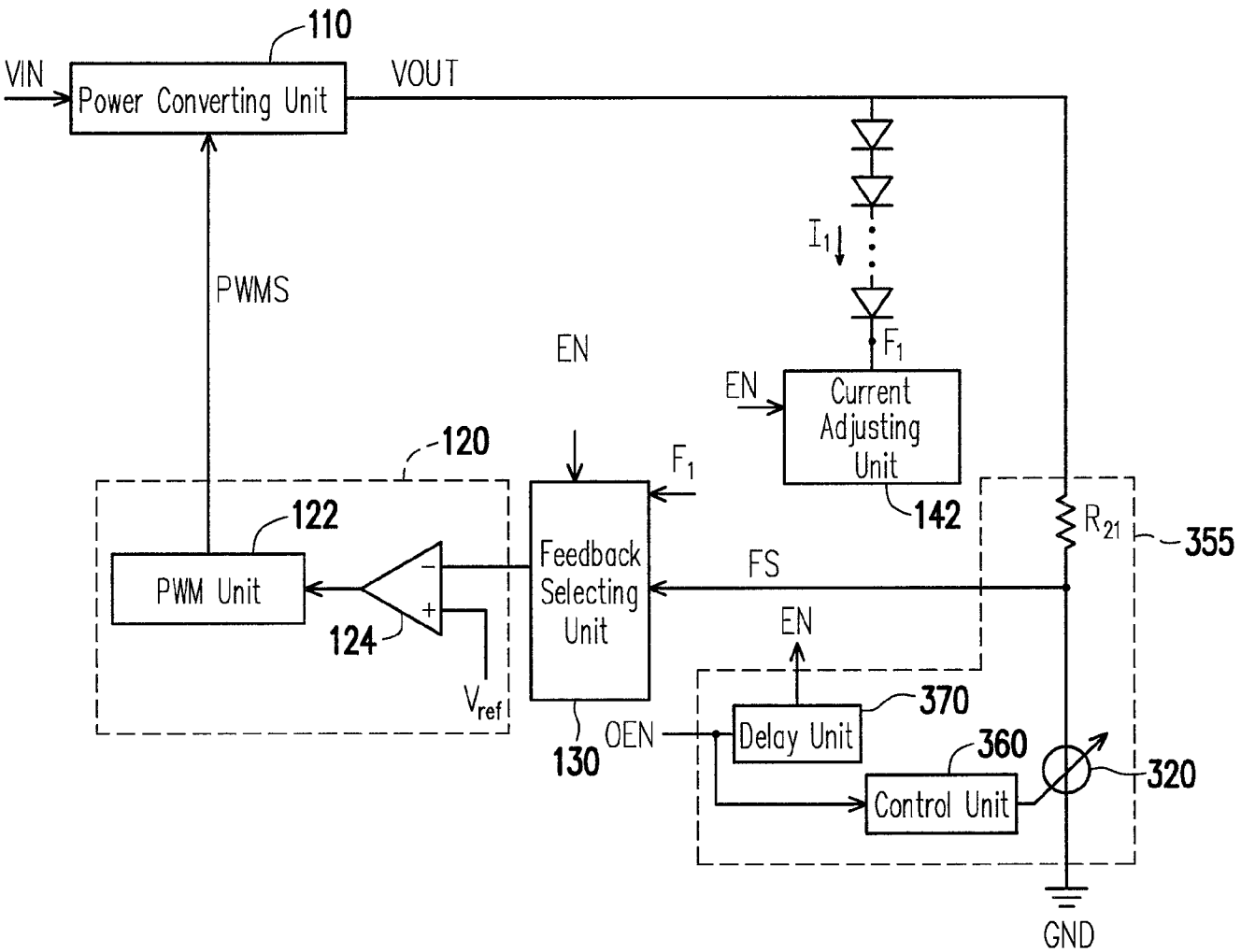
FIG. 3C is a circuit diagram of a driving circuit in accordance with a third embodiment of the invention.

Next, referring to FIG. 3C, FIG. 3C is a circuit diagram of a driving circuit in accordance with a third embodiment of the invention. A difference between FIGS. 3C and 3A lies in a current pre-charging unit 355. The current pre-charging unit 355 includes the resistor $R_{21}$, an adjustable current source 320, a control unit 360, and a delay unit 370. The resistor $R_{21}$ and the adjustable current source 320 are coupled between the driving power VOUT and the ground GND. A node between the resistor $R_{21}$ and the adjustable current source 320 outputs the second feedback signal FS. The control unit 360 is coupled between an original enable signal OEN and the adjustable current source 320. According to the original enable signal OEN, the control unit 360 adjusts a current conducted by the adjustable current source 320. The delay unit is coupled between the feedback selecting unit 130 and the current controlling circuit 142. The delay unit 370 is configured to delay the original enable signal OEN, so as to generate the enable signal EN for the feedback selecting unit 130 and the current controlling circuit 142. During a delayed predetermined time of the original enable signal OEN, the control signal 360 adjusts beforehand the adjustable current source 320 in accordance with a magnitude of current to be conducted by the LED strings, so that the output current of the power converting unit 110 is increased in advance. After the predetermined time, the control unit 360 disables the adjustable current source 320, so that current originally conducted by the current pre-charging unit 355 is directed to the LED strings which are designated to turn on. Likewise, the current pre-charging unit 355 may be configured in FIG. 3B to replace the current pre-charging unit 350.

Figure 4:
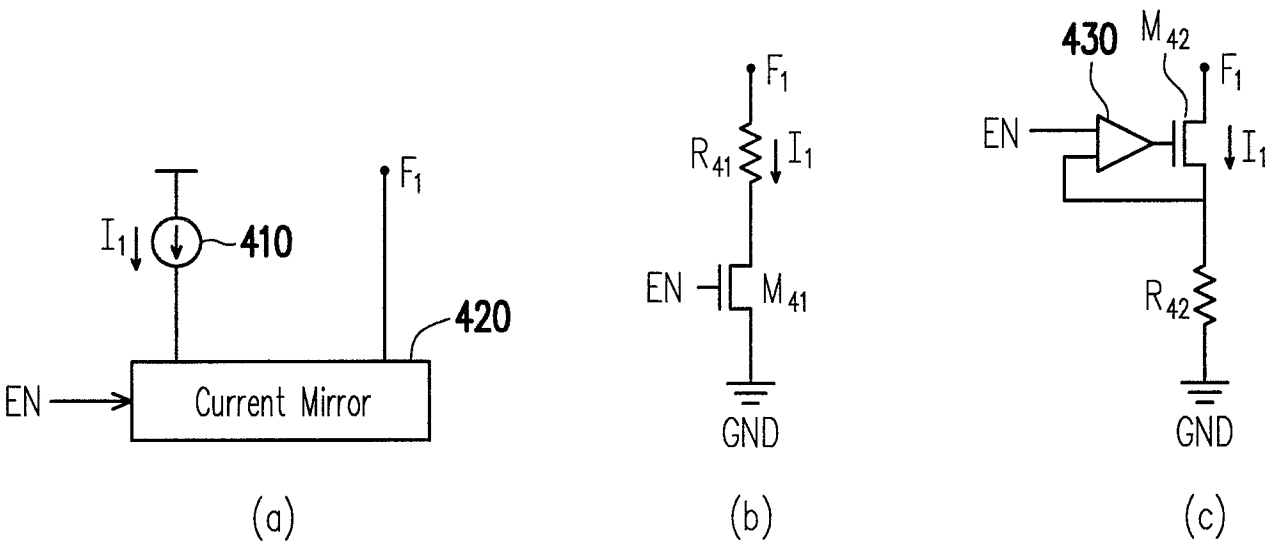
FIG. 4 illustrates a plurality of circuit structures of a current controlling circuit in accordance with an embodiment of the invention.

The above-described current controlling circuits 142 and 144 are configured to control a conducted current of an LED string. According to a design requirement, there may be a plurality of circuit structures for implementing the current controlling circuits 142 and 144, for example as shown in FIG. 4. FIG. 4 illustrates a plurality of circuit structures of a current controlling circuit in accordance with an embodiment of the invention. Taking the current controlling circuit 142 as an example and referring to FIGS. 4(*a*)-4(*c*), in FIG. 4(*a*) the current controlling circuit 142 may be formed by a current source 410 and a current mirror 420, configured to determine a current conducted by a LED string. It should be noted that, whether the current mirror 420 is enabled is controlled by the enable signal EN, and an exemplary implementation thereof may be a switch disposed in a current conducting path of the current mirror 420.

In FIG. 4(*b*), to implement the current controlling circuit 142, a resistor $R_{41}$ is connected in series with a NMOS transistor $M_{41}$ between the first feedback signal F1 and the ground GND. The NMOS transistor $M_{41}$ is controlled by the enable signal EN, and a size of a current conducted by the NMOS transistor $M_{41}$ may be determined by a voltage of the enable signal EN. In FIG. 4(*c*), the current controlling circuit 142 may be formed by an operational amplifier 430, a NMOS transistor $M_{42}$, and a resistor $R_{42}$. The input ends of the operational amplifier 430 are respectively coupled to the enable signal EN and a source of the NMOS transistor $M_{42}$. The resistor $R_{42}$ is coupled between the source of the NMOS transistor $M_{42}$ and the ground GND. It should be noted that, the circuit structures in the above-described FIG. 4 are merely exemplary embodiments of the circuit controlling circuit 142, and the invention is not limited thereto.

The current pre-charging unit 150 is configured to provide the power converting unit 110 another current path, and the current pre-charging unit 150 is adapted to maintain the output current of the power converting unit 110 when the LEDs are turned off. Moreover, in another embodiment of the invention, when the LEDs are about to be lit, the current pre-charging unit 150 may dynamically adjust the output current of the power converting unit 110 according to a corresponding magnitude of current of the enable signal EN, so that the LEDs may receive the needed current in time. For example, when the enable signal EN is about to conduct a current $I_1$ needed by a LED string, the current pre-charging unit 150 increases the output current of the power converting unit 110 by the current $I_1$. When the enable signal EN is about to conduct a current two times $I_1$ needed by a LED string, the current pre-charging unit 150 increases the output current of the power converting unit 110 by two times the current $I_1$. In other words, the current pre-charging unit 150 dynamically adjusts the magnitude of current conducted according to the enable signal EN, so that the output current of the power converting unit 150 may perform adjustments in advance according to the enable signal EN.

Figure 5:
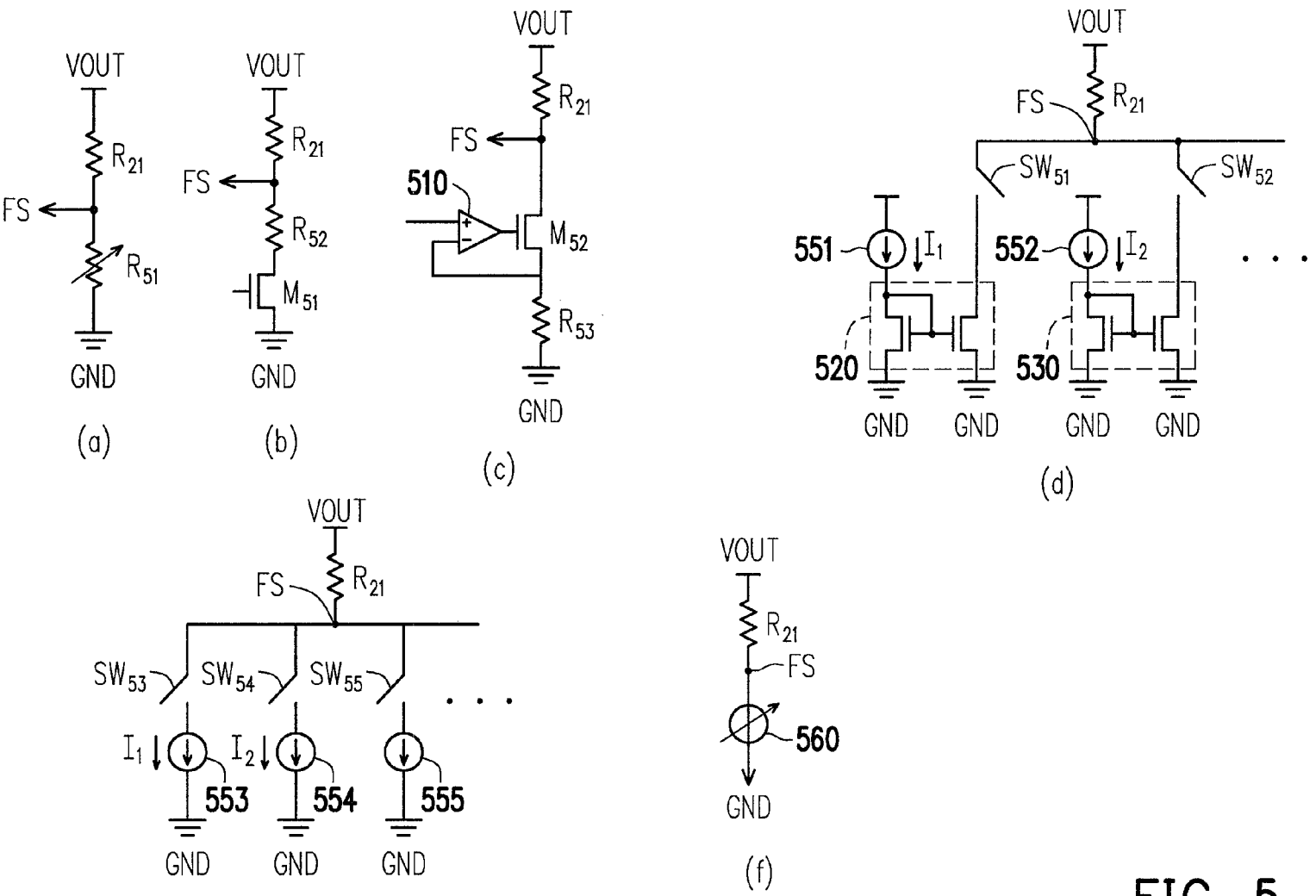
FIG. 5 illustrates a plurality of circuit structures of a current pre-charging circuit in accordance with an embodiment of the invention.

The adjustable current source 320 in the current pre-charging unit 355 may be implemented by various circuit structures according to a design requirement, for example as shown in FIG. 5. FIG. 5 illustrates a plurality of circuit structures of a current pre-charging unit in accordance with an embodiment of the invention. Referring to FIG. 5(*a*), in the current pre-charging unit 150, a resistor $R_{21}$ and an adjustable resistor $R_{51}$ are connected in series between the driving power VOUT and the ground GND. By adjusting a resistance value of the adjustable resistor $R_{51}$, the current pre-charging unit 150 may adjust the output current of the power converting unit 110. In another embodiment of the invention, the adjustable resistor R51 may be directly adjusted by using the feedback selecting unit 130 according to the enable signal EN to adjust the output current of the power converting unit 110.

Next, referring to FIG. 5(*b*), a difference between FIGS. 5(*a*) and 5(*b*) lies in a NMOS transistor $M_{51}$ coupled between a resistor $R_{52}$ and the ground. A gate of the NMOS transistor M51 is coupled to the control unit 360. When the driving circuit enters an energy saving mode, a current path of the current pre-charging unit 355 may be turned off to conserve power consumption. FIG. 5(*c*) illustrates a circuit structure for a constant current, including a resistor $R_{21}$, a NMOS transistor $M_{52}$, an operational amplifier 510, and a resistor $R_{53}$. The resistor $R_{21}$, the NMOS transistor $M_{52}$, and the resistor $R_{53}$ are coupled between the driving power VOUT and the ground GND. A negative input end of the operational amplifier 510 is coupled to a source of the NMOS transistor $M_{52}$. A current conducted by the current pre-charging unit 355 may be controlled through a positive input end of the operational amplifier 510.

Referring to FIG. 5(*d*), FIG. 5(*d*) is formed by a resistor $R_{21}$ and a plurality of current mirrors 520 and 530. The resistor $R_{21}$ is connected to the current mirrors 520 and 530 through a switch $SW_{51}$ and a switch $SW_{52}$, respectively. The current mirrors 520 and 530 respectively mirror a current $I_1$ and a current $I_2$ from a current source 551 and a current source 552. By controlling whether the switches $SW_{51}$ and $SW_{52}$ are turned on, the current flowing through the resistor $R_{21}$ may be adjusted. The switches $SW_{51}$ and $SW_{52}$ may also be controlled by the control unit 360. The current mirrors 520 and 530 depicted in FIG. 5(*d*) may be directly integrated with a current source in the current adjusting unit 140, so as to mirror the conducted currents of each of the LED strings. The current mirrors 520 and 530 may adopt a typical current mirror design, and the width to length ratios of transistors used in the current mirrors 520 and 530 may be based upon a current ratio, thus no further description is provided hereinafter. Moreover, as shown in FIG. 5(*e*), the above-described current mirrors 520 and 530 depicted in FIG. 5(*d*) may be directly represented as current sources. In FIG. 5(*e*), a resistor $R_{21}$ is coupled to a current source 553, a current source 554, and a current source 555 through a switch $SW_{53}$, a switch $SW_{54}$, and a switch $SW_{55}$, respectively. By controlling whether the switches $SW_{53}$, $SW_{54}$, and $SW_{55}$ are turned on, the current flowing through the resistor $R_{21}$ may be adjusted. Likewise, the switches $SW_{53}$, $SW_{54}$, and $SW_{55}$ may also be controlled by the feedback selecting unit 130.

As described above in FIGS. 5(*a*)-5(*e*), the circuit structure of the current pre-charging unit 150 may be formed by a resistor and an adjustable current source, as shown in FIG. 5(*f*). In FIG. 5(*f*), a resistor $R_{21}$ and an adjustable current source 560 are connected in series between the driving power VOUT and the ground GND. For the circuit structure of the adjustable current source 560, please refer to the implementations illustrated in the aforementioned FIGS. 5(*a*)-5(*e*), although the invention is not limited thereto. The current magnitude of the adjustable current source 560 may be adjusted according to the enable signal EN or design requirement, so that the current magnitude of the adjustable current source 560 may be set at a predetermined value, so as to maintain the magnitude of output current from the power converting unit 110.

In light of the foregoing, an embodiment of the invention adds a current pre-charging unit (e.g., 150, 350, or 355) at the output end of the power converting unit 110. This current pre-charging unit may be enabled in advance of the LEDs being conducted, so that the output current of the power converting unit 110 is raised beforehand to increase a driving capability thereof. When the LEDs are turned on, this current path is automatically turned off, thereby allowing the LEDs to rapidly receive a required magnitude of current. In a dynamic display process, the current pre-charging unit may coordinate with the adjustable current source to delay the enable signal of the LEDs a period of time. In this delay time period, the output current of the power converting unit 110 is raised in advance. When the LEDs are turned on, a current path is automatically turned off, so as to allow the LEDs to obtain the required current magnitude. By setting the current pre-charging unit, the output current of the power converting unit 110 may be adjusted beforehand, so that the LEDs may be rapidly turned on.

Moreover, the above-described current adjusting unit 140 and the current pre-charging units 150, 350, and 355 are configured to control a current magnitude, and to generate feedback signals for adjusting the output of the power converting unit 110. The circuit structures depicted in the above-described FIGS. 4 and 5 serve only as exemplary embodiments of the current adjusting unit 140 and the current pre-charging unit 150, and thus the invention is not limited thereto. Persons of ordinary skill in the art may easily derive other feasible circuit structures by referring to the disclosure of the invention, and details are not further described hereinafter. The NMOS transistor depicted in FIGS. 4 and 5 may be implemented as a PMOS transistor, with corresponding adjustments to the circuit structure.

Fourth Embodiment

Figure 6:
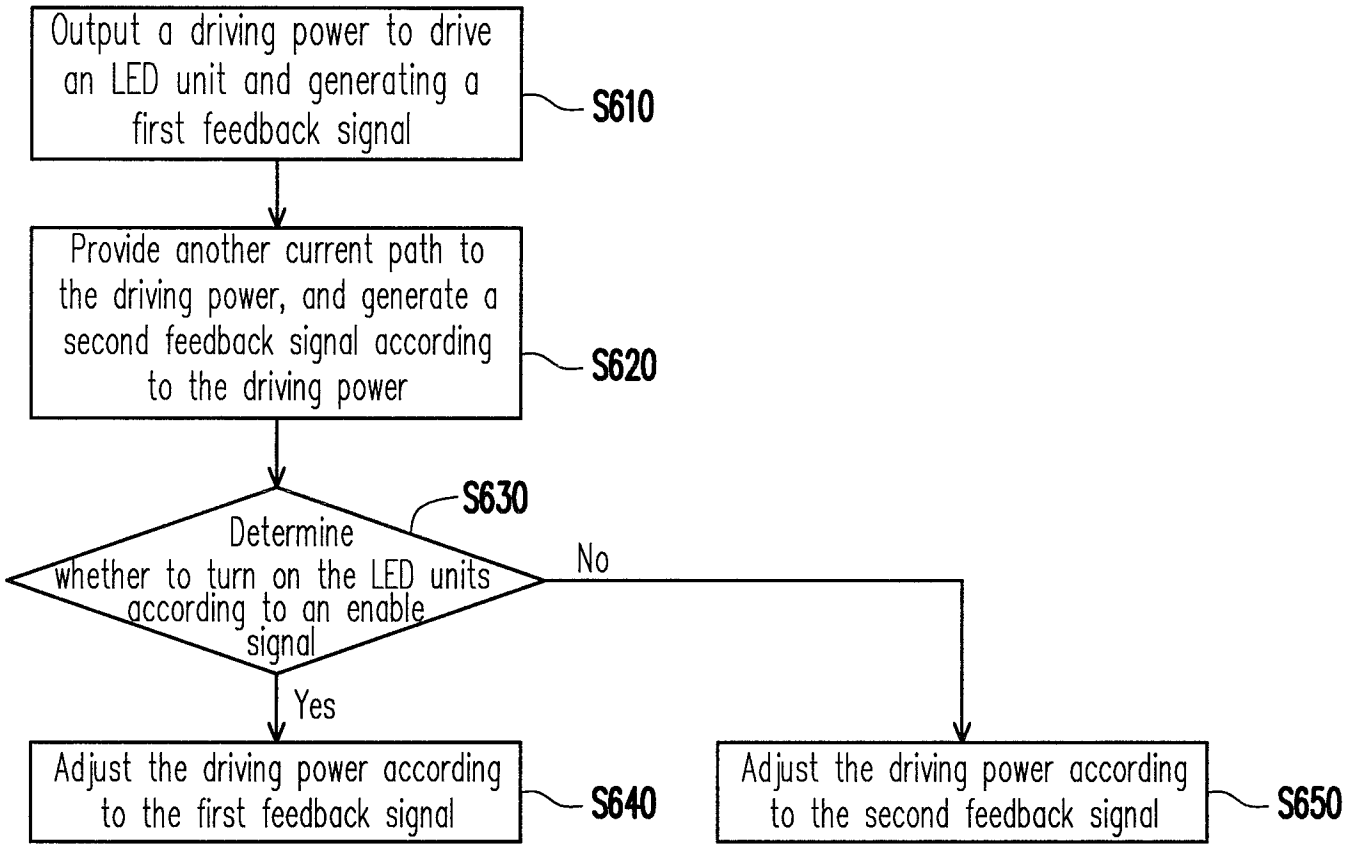
FIG. 6 is a flow chart of an LED driving method in accordance with a fourth embodiment of the invention.

From another perspective, a driving method of an LED may be generalized from the aforementioned embodiment, as illustrated in FIG. 6. FIG. 6 is a flow chart of a driving method in accordance with a fourth embodiment of the invention. The driving power is outputted to drive an LED unit and generate a first feedback signal (Step S610). In this step, the first feedback signal is used to adjust a voltage and a current of the driving power, so that the LED unit receives a sufficient driving current. Another current path is provided to the driving power, and according to a current conducted by this current path, a second feedback signal is generated (Step S620). In a driving process of the LED unit, the enable signal determines whether to turn on the LEDs in the LED unit (Step S630). When the LEDs in the LED unit are turned on, the driving power is adjusted according to the first feedback signal (Step S640), and when the LED unit is turned off, the driving power is adjusted according to the second feedback signal (Step S650). Since the driving power is adjusted in accordance with the second feedback signal when the LED unit is turned off, the driving power may be adjusted by modifying the current conducted by the above-described current path, so that a sufficient current driving capability is provided in advance.

The aforementioned driving method provides an extra current path in the driving circuit of the LEDs. By adjusting a current magnitude of the driving power through this current path, the current driving capability of the driving power may match a current requirement for conducting the LEDs, so that a switching speed of the LEDs is accelerated. Please refer to the foregoing description of FIGS. 1-5 for the remaining operating details of the driving method. Thus, a detailed description thereof is omitted.

In light of the foregoing, an embodiment of the invention provides a method to enhance a driving capability of an LED driving circuit, in which an extra current path is disposed in the driving circuit for maintaining a current output capability thereof. Alternatively, according to a current magnitude required for conducting an LED string, an output current of the driving circuit may be adjusted in advance, so that the LEDs may be switched rapidly to receive the required driving current.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A driving circuit adapted to drive at least one light emitting diode (LED) unit, the LED unit comprising at least one LED, the driving circuit comprising:

a driving unit, having a first output terminal for outputting a driving power to the LED unit;

a feedback unit, for generating at least one first feedback signal in accordance with a current conducted in the LED unit; and a current pre-charging unit having a first input terminal coupled to the first output terminal of the driving unit, providing a current path to the driving power and generating a second feedback signal in accordance with the driving power;

wherein an enable signal is used to determine whether to conduct the driving power to the LED unit, wherein when the enable signal is at a first logic level, the driving power is conducted to the LED unit, and one of the at least one first feedback signal is selected and conducted to the driving unit for adjusting the driving power; and when the enable signal is at a second logic level, the second feedback signal is selected and conducted to the driving unit for adjusting the driving power, and the driving power is not conducted to the LED unit.

2. The driving circuit as claimed in claim 1, wherein when the second feedback signal is conducted to the driving unit for adjusting the driving power, the current of the driving power is maintained at a predetermined value.

3. The driving circuit as claimed in claim 1, wherein the current pre-charging unit comprises:

a first resistor; and a second resistor;

wherein the first resistor and the second resistor are serially coupled between the output of the driving unit and a ground, wherein a node between the first resistor and the second resistor generates the second feedback signal.

4. The driving circuit as claimed in claim 1, wherein the current pre-charging unit comprises:

a first resistor;

a second resistor serially coupled with the first resistor, wherein the serial resistors are between the first output terminal of the driving unit and one end of a switch, wherein another end of the switch is coupled to the ground, and a node between the first resistor and the second resistor generates the second feedback signal; and an inverter having an input end coupled to the enable signal and an output end coupled to the switch;

wherein when the enable signal is at the second logic level disabled, the switch is turned on; when the enable signal is at the first logic level, the switch is turned off.

5. The driving circuit as claimed in claim 1, wherein the driving unit comprises:

a power converting unit coupled to the LED unit, for converting an input voltage to the driving power;

a current adjusting unit coupled to the LED unit, selectively turning on the LEDs in the LED unit and generating the at least one first feedback signal; and a pulse width modulating (PWM) unit coupled to the at least one first feedback signal and the power converting unit, for adjusting an output of the power converting unit.

6. The driving circuit as claimed in claim 5, wherein the LEDs in the LED unit are serially coupled to form at least one LED string, the at least one LED string being coupled between the output of the power converting unit and the current adjusting unit, wherein nodes between the at least one LED string and the current adjusting unit generate the at least one first feedback signal.

7. The driving circuit as claimed in claim 6, wherein when the enable signal is at the first logic level, the current adjusting unit selectively turns on the at least one LED string, wherein one of the at least one first feedback signal corresponding to an output of a turned-on LED is selected and conducted to the driving unit to adjust the driving power.

8. The driving circuit as claimed in claim 7, wherein the output of the selected LED has the smallest voltage among the at least one LED string.

9. The driving circuit as claimed in claim 5, wherein the power converting unit is a boost circuit.

10. The driving circuit as claimed in claim 5, wherein the current adjusting unit comprises a plurality of current adjusting circuits, wherein each of the current adjusting circuits is coupled to a corresponding LED to adjust the current flowing in the LED.

11. The driving circuit as claimed in claim 1, wherein the current pre-charging unit comprises:

a first resistor having an end coupled to the output of the driving unit; and an adjustable current source coupled between another end of the first resistor and a ground;

a control unit coupled to the adjustable current source, for adjusting a conducted current of the adjustable current source in accordance with a pre-enable signal; and a delay unit coupled to the pre-enable signal, for delaying the pre-enable signal for a predetermined time so as to output the enable signal;

wherein a node between the adjustable current source and the first resistor outputs the second feedback signal, and, during the predetermined time, the control unit changes the current conducted by the adjustable current source in accordance with the pre-enable signal.

12. The driving circuit as claimed in claim 11, wherein the control unit disables the adjustable current source after the predetermined time.

13. The driving circuit as claimed in claim 11, wherein the adjustable current source comprises:

at least one current mirror circuit coupled to the first resistor through a plurality of switches, for selectively mirroring a current corresponding to the LEDs which are turned on, in accordance with the pre-enable signal.

14. The driving circuit as claimed in claim 11, wherein the adjustable current source comprises:

an operational amplifier having a positive input end coupled to a reference voltage outputted by the control unit;

a NMOS transistor having a drain coupled to another end of the first resistor, a source coupled to a negative input end of the operational amplifier, and a gate coupled to an output end of the operational amplifier; and a second resistor coupled between the source of the NMOS transistor and the ground.

15. The driving circuit as claimed in claim 11, wherein the adjustable current source comprises:

a plurality of switches coupled between the first resistor and a plurality of current sources, wherein the switches are controlled by the control unit.

16. A driving method of an LED, comprising:

outputting a driving power to drive an LED unit and generating at least one first feedback signal;

providing a current path to the driving power and generating a second feedback signal in accordance with a current conducted by the current path; and determining whether to conduct the driving power to the LED unit in accordance with an enable signal, wherein when the enable signal is at a first logic level, the driving power is conducted to the LED unit, and one of the at least one first feedback signal is selected and conducted to the driving unit; and when the enable signal is at a second logic level, the second feedback signal is selected and conducted to the driving unit for adjusting the driving power, and the driving power is not conducted to the LED unit.

17. The driving method as claimed in claim 16, further comprising adjusting a current of the driving power in accordance with the second feedback signal, wherein when the LED unit is turned off, the current of the driving power is maintained at a predetermined value.

18. The driving method as claimed in claim 16, wherein the step of determining whether to turn on the LEDs in accordance with the enable signal further comprises:

receiving a pre-enable signal;

delaying the pre-enable signal a predetermined time to generate the enable signal; and adjusting the current conducted in the current path in accordance with the pre-enable signal during the predetermined time.

19. The driving method as claimed in claim 17, wherein the LED unit comprises at least one LED string.

* * * * *